US005199447A

United States Patent [19]

Budjinski, II et al.

[11] Patent Number: 5,199,447

[45] Date of Patent: Apr. 6, 1993

[54] APPARATUS FOR HIGH SPEED DELIVERY OF FREE FLOWING MATERIAL

[75] Inventors: Joseph F. Budjinski, II, Quinton; Charles G. Atwell, Mechanicsville; Martin T. Garthaffner, Midlothian, all of Va.

[73] Assignee: Philip Morris Incorporated, New York, N.Y.

[21] Appl. No.: 828,423

[22] Filed: Jan. 31, 1992

[51] Int. Cl.[5] ..... A24C 5/47; A24C 5/52

[52] U.S. Cl. ..... 131/94; 493/47; 493/48

[58] Field of Search ..... 131/84.1, 88, 94; 141/72, 78, 85, 89; 493/47, 48

[56] References Cited

U.S. PATENT DOCUMENTS 3,348,455 10/1967 Williamson et al. ..... 493/47
3,464,324 9/1969 Pinkham .
3,545,345 12/1970 Aronson .
3,623,404 11/1971 Jackson .

*Primary Examiner*—V. Millin
*Assistant Examiner*—J. Doyle

[57] ABSTRACT

This invention relates to two parallel belts with pockets suspended between them. This pockets device is used in a machine which delivers free flowing material into receiving spaces separating filter plugs, as said plugs travel on a garniture tape. The pockets include channels or funnels through which free flowing material can flow. The belts carry the pockets in part parallel with and adjacent to the garniture tape carrying the filter plugs. The belts and the garniture tape are synchronized so that receiving spaces between the plugs precisely register with the funnels in the pockets. Such precise registry insures that the charcoal chute delivers free flowing material through the funnels into the receiving spaces.

8 Claims, 7 Drawing Sheets

APPARATUS FOR HIGH SPEED DELIVERY OF FREE FLOWING MATERIAL

BACKGROUND OF THE INVENTION

The present invention is directed to an apparatus for high speed delivery of free flowing material. It includes a pair of parallel endless belts with a series of units called pockets suspended between them. It is particularly useful for delivery of free flowing material in cigarette manufacturing. This invention is used in a device which delivers free flowing material, such as charcoal granules, into receiving spaces separating filter plugs, as the plugs move on a conveyor (in the tobacco art, such a conveyor is called a garniture tape).

Several devices in the prior art, including one described in U.S. Pat. No. 3,623,404, include a belt or chain consisting of an endless series of links. In such devices, each link is connected to the preceding and following links forming an endless chain. The chain travels around a plurality of wheels or sprockets which provide the chain with drive, tension and position. The chain travels in part parallel with and adjacent to a garniture tape transporting a series of axially aligned filter plugs separated by spaces.

The links comprising such chains contain channels or funnels capable of channelling particulate matter. As the chain and the garniture tape travel parallel with one another, the links travel adjacent to the axially aligned filter plugs. During this adjacent travel, the funnels within the links register with the spaces between the filter plugs, and a dispenser delivers particulate matter to the funnels within the links. The funnels channel this particulate matter into the adjacent receiving spaces.

Likewise, U.S. Pat. No. 3,464,324 includes an alternative embodiment utilizing a linked chain. This chain includes a web portion provided with a slot which allows the passage of granular material into voids separating filter plugs.

These presently utilized chains experience loss of tolerance in the connections between the individual links. Loss of tolerance in the connections causes variability in distance between the links, resulting in variability in distance between the apertures within the links. Due to this variability, apertures moving parallel with and adjacent to receiving spaces do not maintain registration with said spaces. This disfunction between apertures and receiving spaces results in inaccurate delivery of particulate material.

It would be desirable to replace these chains in the prior art with a pair of parallel endless belts with a series of units called pockets suspended between them. The pockets would contain funnels for channelling free flowing material and thereby replace the links in prior art devices. By eliminating links, the pockets device eliminates the tolerance which accompanies the connections between such links. Connecting individual pockets between parallel belts insures uniform spacing between the pockets and the funnels they contain. Such uniform spacing would help facilitate the accurate registry of the funnels with the parallel moving receiving spaces. Thus, pockets travelling adjacent to a garniture tape transporting filter plugs would deliver free flowing material into the receiving spaces more accurately than link devices.

SUMMARY OF THE INVENTION

In view of the foregoing, it is an object of this invention to deliver free flowing material accurately into receiving spaces in separating axially aligned filter plugs, as the plugs travel at high speed on a garniture tape.

It is a further object to provide a device including parallel belts with pockets suspended between them, for delivering free flowing material into receiving spaces between filter plugs.

These and other objects of the invention are accomplished by providing a device including two parallel endless belts with a series of units called pockets suspended between them. These pockets contain channels or funnels for channelling free flowing material.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which.

DETAILED DESCRIPTION OF THE PREFERRED EMBODIMENTS

Figure 1:
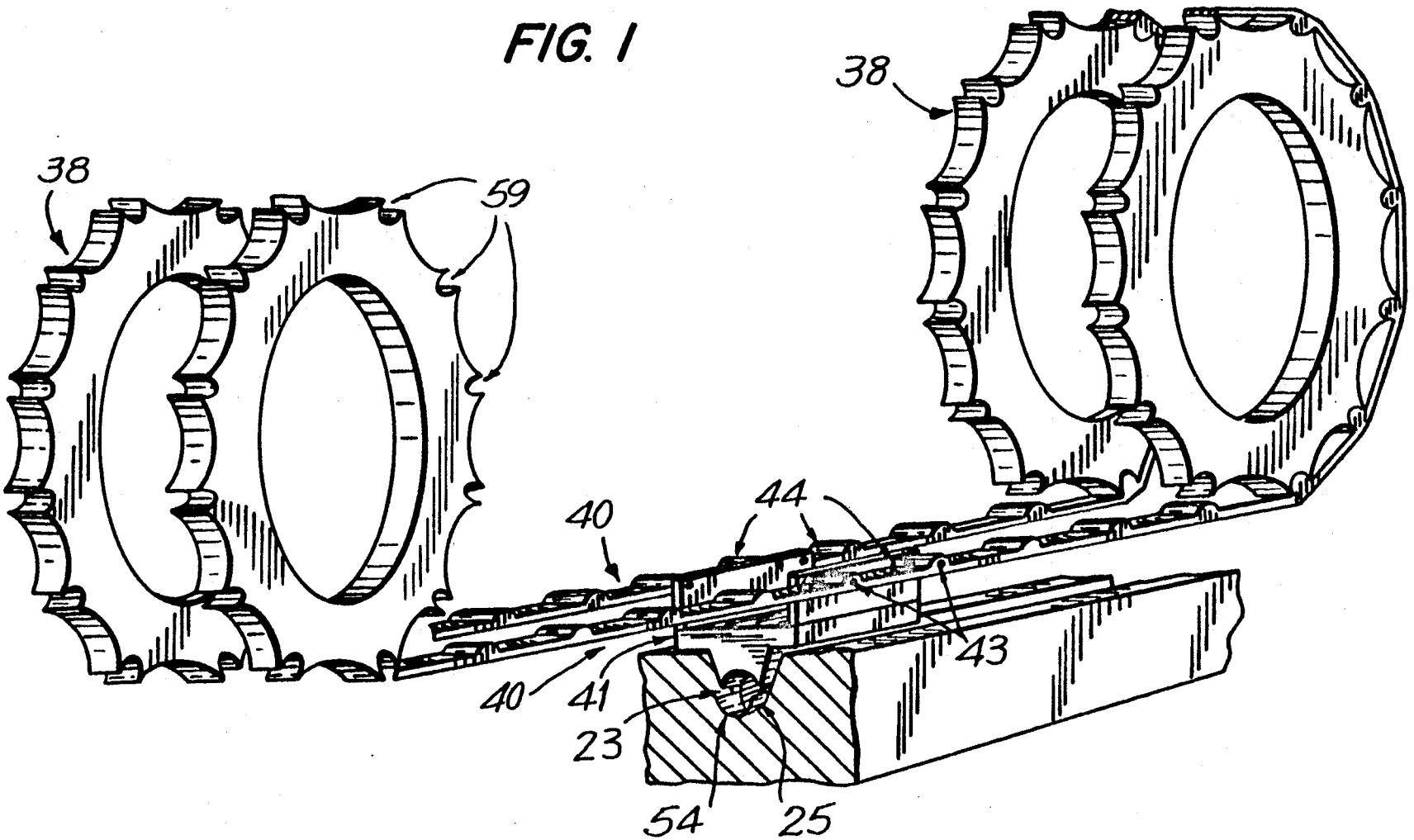
FIG. 1 is a perspective view in fragmentary form of the apparatus, illustrating diagrammatically the basic relationship of the parallel belts to the wheels and to a pocket.
Figure 2:
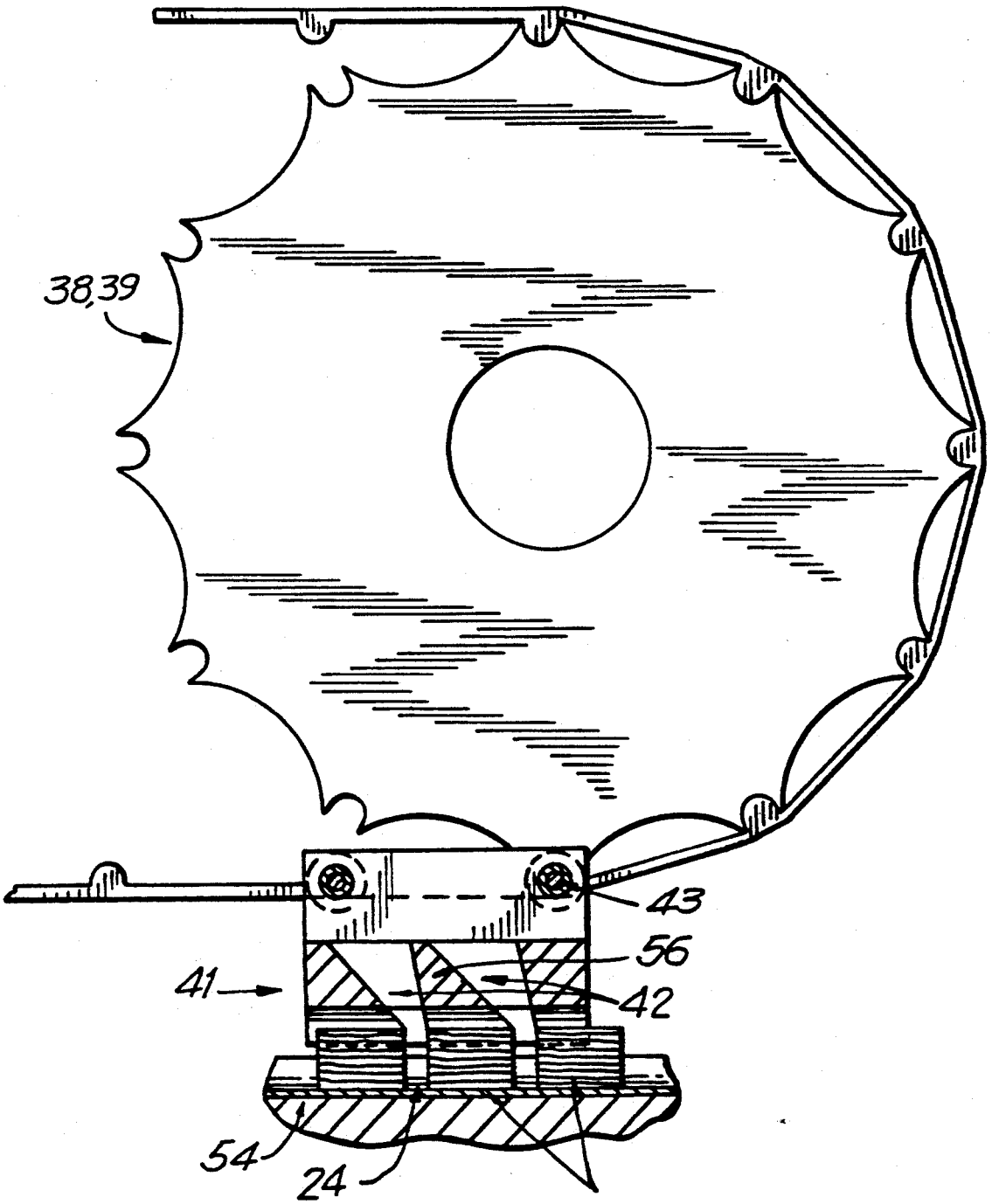
FIG. 2 is a side sectional view of the pocket, illustrating diagrammatically the basic relationship of the pocket to the wheel of FIG. 1.
Figure 3:
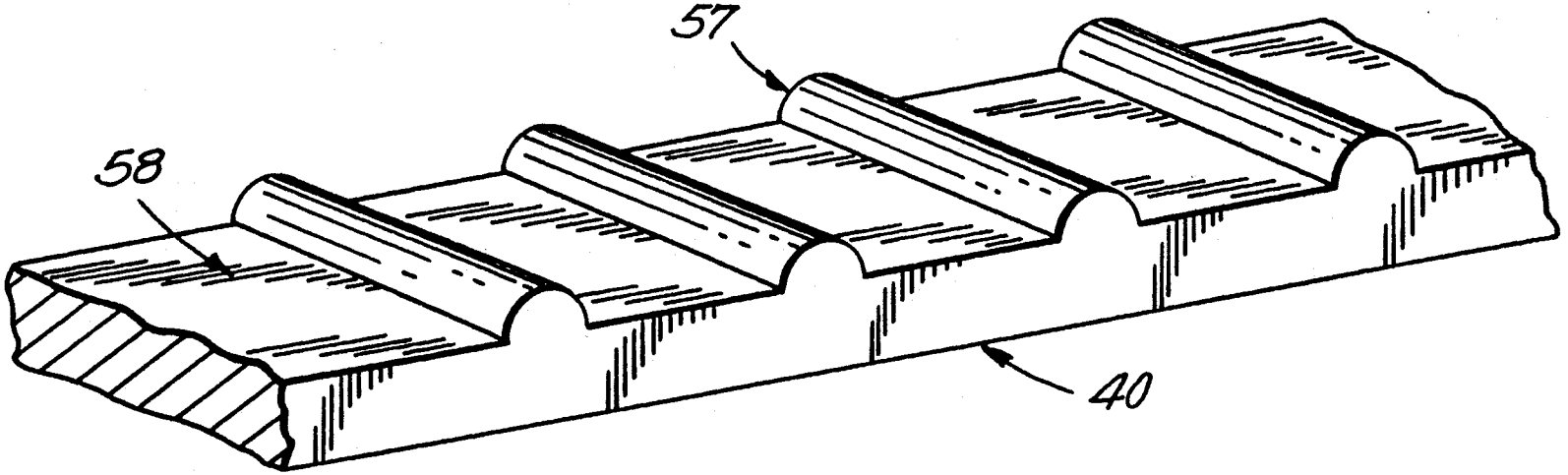
FIG. 3 is a perspective view on fragmentary form of the belt.
Figure 4:
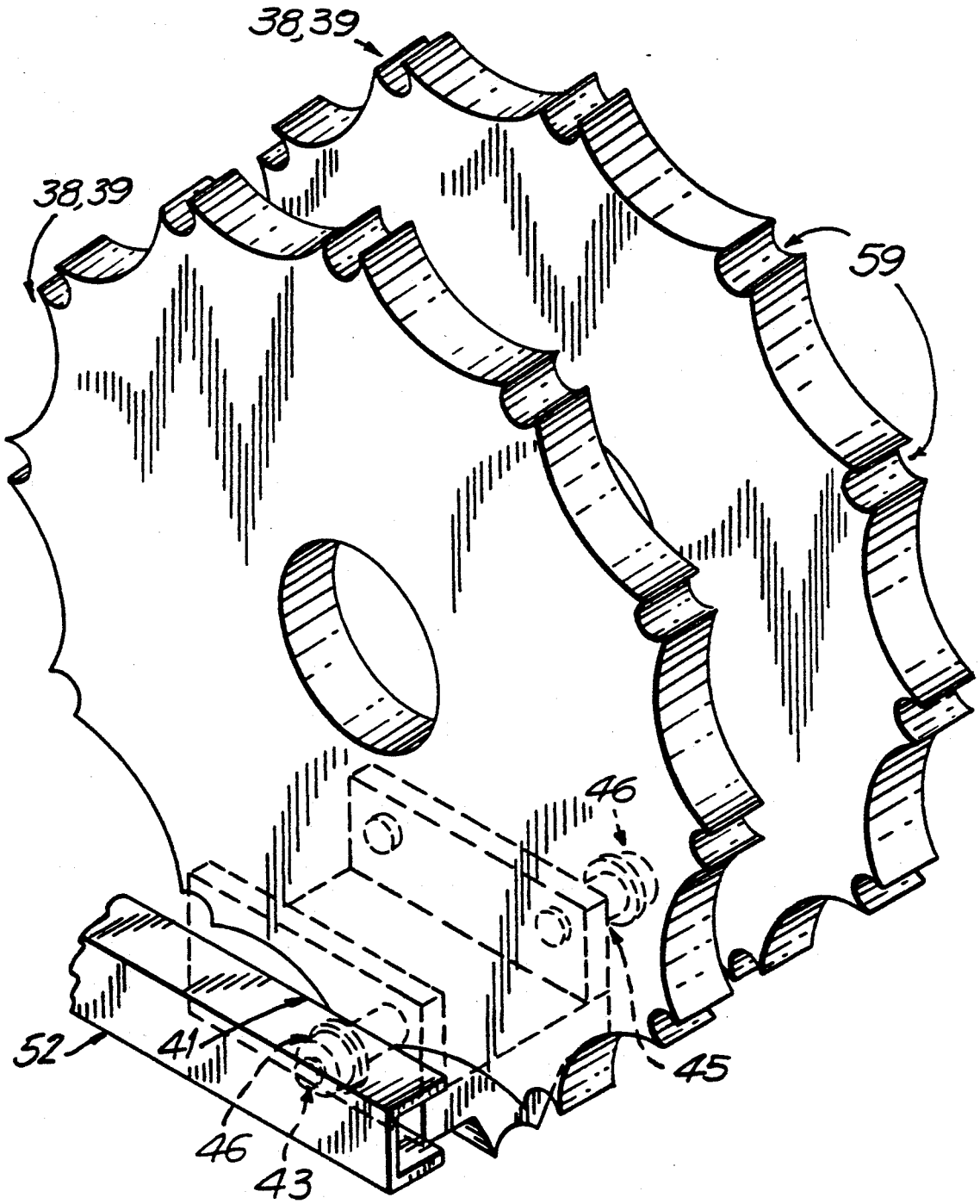
FIG. 4 is a perspective view in fragmentary form of the apparatus, illustrating diagrammatically the basic relationship of the pocket to the wheel.
Figure 5:
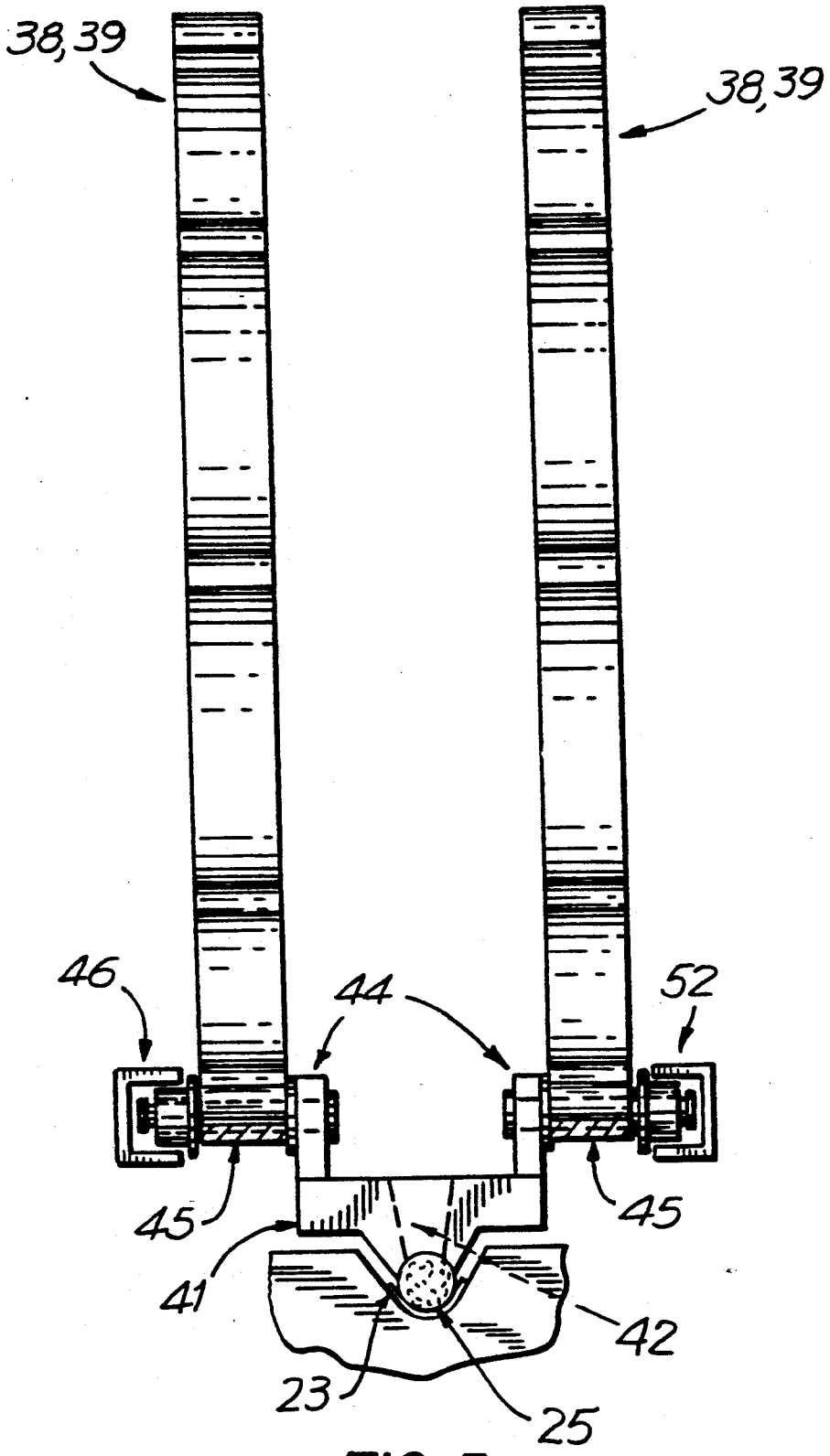
FIG. 5 is a side view in fragmentary form of the apparatus, illustrating diagrammatically the basic relationship of the pocket to the wheel.
Figure 6:
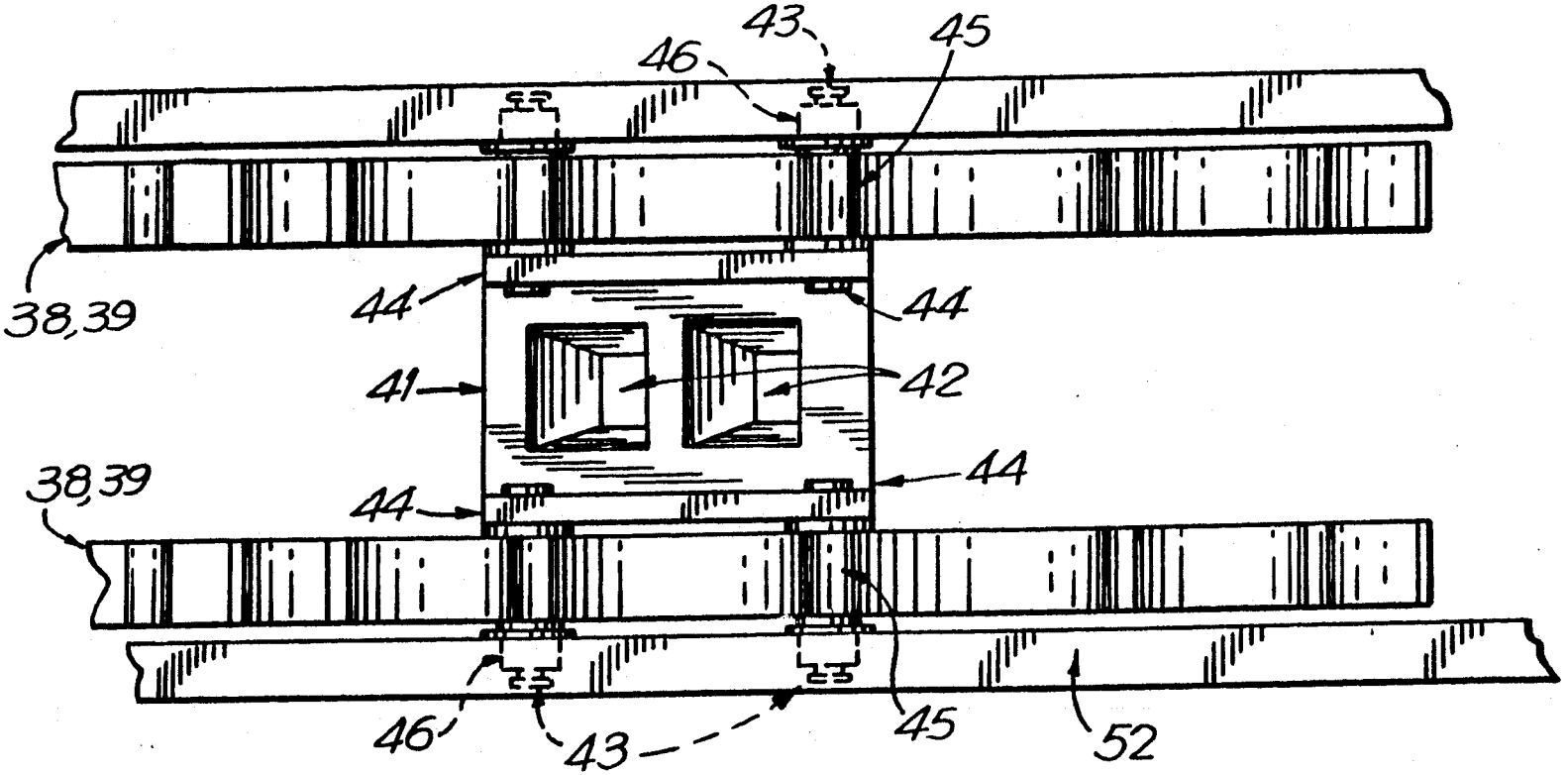
FIG. 6 is a top plan view in fragmentary form of the apparatus, illustrating diagrammatically the basic relationship of the pocket to the wheel.
Figure 7:
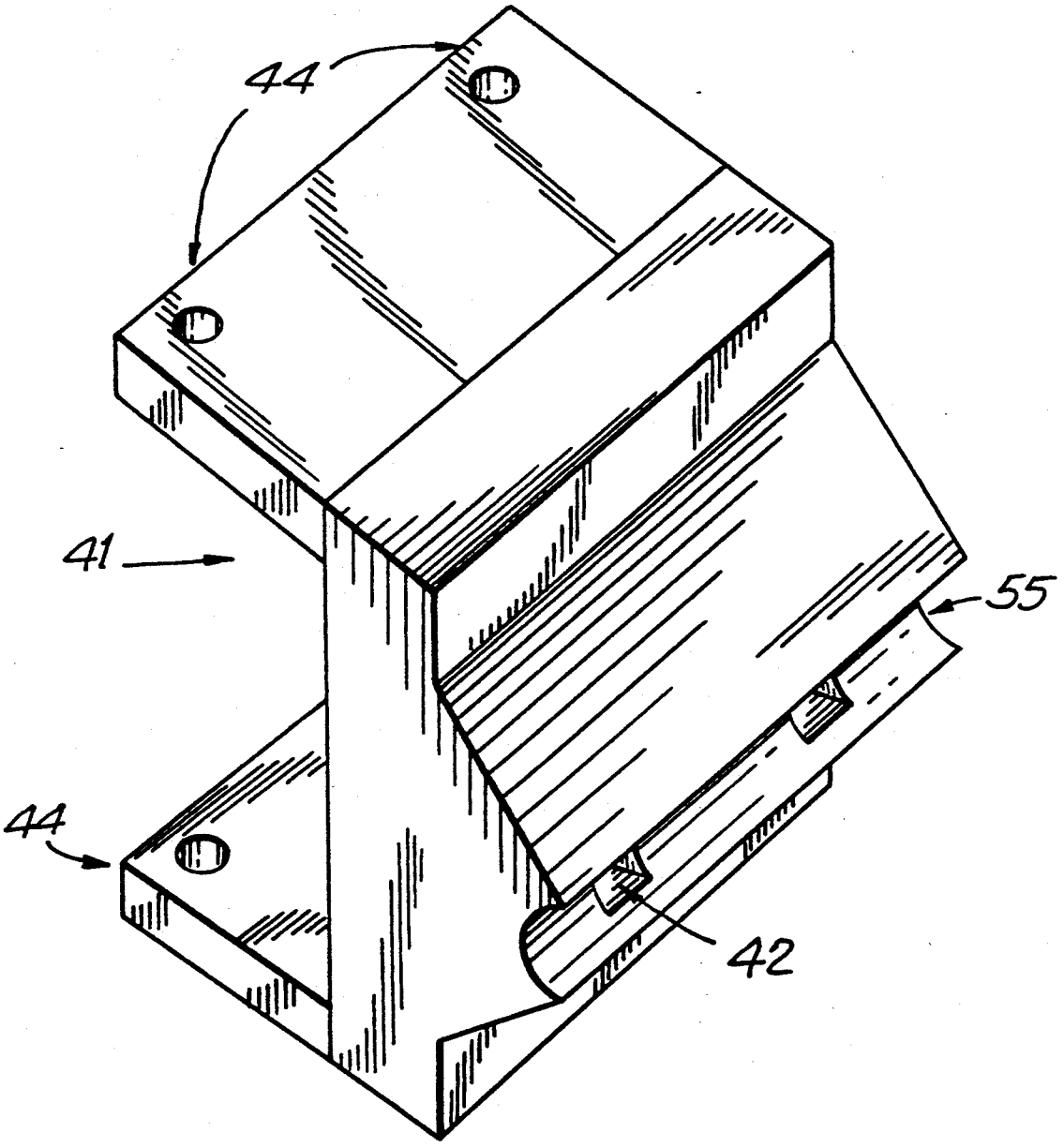
FIG. 7 is a perspective view of the pocket of FIGS. 1, 2, 4–6.

Referring to the drawings, FIGS. 1 and 2 illustrates the parallel belts 40 with a pocket 41 suspended between them. FIG. 3 illustrates the belt 40. FIGS. 4 through 6 illustrate the relationship of the end sprockets 38 with a pocket 41. FIG. 7 illustrates the pocket 41.

Belts 40 each travel around end sprockets 38 which provide drive, tension and position for belts 40. Belts 40 may be standard industrial grade belts found on the market, such as the high torque drive belt 1890 14 M 55 made by T. B. Wood's Sons Co. These belts need not be specially fabricated. Two identical belts 40 may be created by simply cutting one high torque drive belt lengthwise.

These high torque drive belts include semicircular shaped projections 57 regularly spaced around the belt's inner surface 58. A series of recesses 59 are evenly spaced around the outer circumference of the sprockets 38. These recesses 59 correspond with, accommodate and mate with the belt projections 57 as the belts 40 travel around and between the sprockets 38.

Free flowing material channelling devices called pockets 41 are suspended between the parallel belts 40. As the sprockets 38 turn, they drive the parallel belts 40 which in turn transport the pockets 41 suspended between them. Each pocket 41 includes one or more funnels 42 functioning to channel free flowing material. The pockets 41 are fastened between belts 40 using steel pins 43 which extend completely through pockets 41 and belts 40. Each of the four corners 44 of pockets 41 are attached by a steel pin 43 to a belt 40. Pins 43 pass through belts 40 surrounded by bushing 45. Pins 43 then each pass through a roller 46 on the opposite side of belt 40.

As the belts travel around the end sprockets, the rollers 46 travel in part within a groove-like track 52. This track 52 serves to contain the rollers and thus securely position the attached pockets 41. Also, pockets 41 directly communicate with and slide within positioning track 23, an arrangement which further serves to position pockets 41. This positioning track 23 terminates beneath the travel of the pockets 41 in a round shaped trough called a garniture 25. A flexible garniture tape 54 travels through garniture 25, assuming the round shape of garniture 25. The round shaped garniture 25 accommodates the round shape of the filter plugs 26 which travel through garniture 25 on garniture tape 54.

The garniture tape 54 transports filter plugs 26 in an axially aligned configuration, each plug separated by a receiving space 24. Parallel belts 40 travel in part parallel with the travel of garniture tape 54 such that the pockets 41 travel adjacent to the filter plugs 26 transported on garniture tape 54. The pockets 41 contact the filter plugs 26 during this adjacent travel. The under surface 55 of the pockets 41 terminates in a concave shape 55 to closely accommodate the round shape of filter plugs 26.

A known synchronous drive (not shown) synchronizes the travel of the belts 40 with the travel of the garniture tape 54. This synchrony ensures that funnels 42 of pockets 41 register with the receiving spaces 24 between the filter plugs 26, while pockets 41 and garniture tape 54 travel parallel with one another. The registry of funnels 42 with receiving spaces 24 allows a known charcoal chute device (not shown) to deliver free flowing material through funnels 42 into receiving spaces 24. The non-funnel portion 56 of pockets 41 act to mask the filter plugs from exposure to the free flowing material.

Belts 40 carry pockets 41 suspended at constant, non-variable intervals, facilitating the precise registration of the funnels 42 with the receiving spaces 24. This precise registration in turn facilitates the accurate delivery of free flowing material into the receiving spaces 24 between filter plugs 26 as the plugs move at high speeds on garniture tape 54.

One skilled in the art will appreciate that the present invention can be practiced by other than the described embodiments, which are presented for purposes of illustration and not of limitation and the present invention is limited only by the claims which follow.

We claim:

1. In an apparatus for inserting free flowing material into receiving spaces between filter plugs for use in construction cigarette filters, the improvement comprising, two continuous parallel belts composed of a continuous unlinked material traveling around and between a plurality of sprockets with individual pockets suspended between the belts, said pockets including funnels to receive and channel free flowing material, the belts traveling in part parallel with and adjacent to a garniture tape carrying the filter plugs, while the funnels in the pockets channel free flowing material into the receiving spaces between filter plugs, said belt maintaining consistent spacing between said funnels.

2. The apparatus according to claim 1 wherein the under-surface of the pockets contacts the filter plugs as the belts carry the pockets parallel with and adjacent to the garniture tape, said under-surface terminating in a concave shape to accommodate the round shape of the filter plugs.

3. The apparatus of claim 1 wherein the parallel belts move in synchrony with the garniture tape so that the funnels in the pockets register with the receiving spaces between the filter plugs delivered by the garniture tape.

4. The apparatus according to claim 1 wherein pins attach the pockets to the belt and attach to a roller on the side of the belt opposite the pockets.

5. The apparatus according to claim 4 wherein the rollers travel in part through a track which positions the attached pockets.

6. The apparatus of claim 1 wherein the belts include semicircular-shaped projections around the belt's inner surface that accommodate and mate with evenly spaced recesses around the outer circumference of the sprockets.

7. The apparatus of claim 1 wherein the individual pockets between the belts are fixedly attached with a uniform distance between said pockets.

8. The apparatus of claim 1 wherein each pocket includes a plurality of funnels.

* * * * *